United States Patent [19]

Fusco

[11] Patent Number: 5,070,963

[45] Date of Patent: Dec. 10, 1991

[54] FOLDABLE EXTENSION ESCAPE LADDER BOOKSHELF/TABLE/STOOL/CHEST OF DRAWS

[76] Inventor: Donald O. Fusco, 1 Hastings Dr., Horsham, Pa. 19044

[21] Appl. No.: 651,519

[22] Filed: Feb. 6, 1991

[51] Int. Cl.[5] ..... E06C 1/36; E06C 1/383; E06C 7/00

[52] U.S. Cl. ..... 182/35; 182/135; 182/206

[58] Field of Search ..... 182/20, 35, 163, 206, 182/195

[56] References Cited

U.S. PATENT DOCUMENTS 595,453 12/1897 Fischer ..... 182/195
3,946,833 3/1976 Riehlmann ..... 182/20
3,946,834 3/1976 Shafet et al. ..... 182/164
4,425,983 1/1984 Reinhard ..... 182/96

*Primary Examiner*—Reinaldo P. Machado
*Attorney, Agent, or Firm*—Richard L. Miller

[57] ABSTRACT

An improved foldable extension escape ladder is provided and consists of a plurality of ladder segments. A mechanism for oppositely hinging each ladder segment to each other so that when in a folded position it will be used as a piece of furniture and when in an unfolded position it will be used as the escape ladder. Another mechanism is for retaining the ladder segments together in the folded up position and hanging the ladder segments by the first ladder segment, from an open window of a building in the unfolded position so that a person may climb down the escape ladder to the ground during a fire.

4 Claims, 1 Drawing Sheet

FOLDABLE EXTENSION ESCAPE LADDER BOOKSHELF/TABLE/STOOL/CHEST OF DRAWS

BACKGROUND OF THE INVENTION

The instant invention relates generally to fire escape ladders and more specifically it relates to an improved foldable extension escape ladder.

Numerous fire escape ladders have been provided in the prior art that are adapted to fold, collapse and be self storing when not in use. For example, U.S. Pat. Nos. 3,946,833 to Riehlmann; 3,946,834 to Shafer et al. and 4,425,983 all are illustrative of such prior art. While these units may be suitable for the particular purpose to which they address, they would not be as suitable for the purpose of the present invention as hereafter described.

SUMMARY OF THE INVENTION

A primary object of the present invention is to provide an improved foldable extension escape ladder that will overcome the shortcomings of the prior art devices.

Another object is to provide an improved foldable extension escape ladder that is fabricated to be a useful piece of furniture when not in use and can be utilized as a fire escape ladder during a fire.

An additional object is to provide an improved foldable extension escape ladder that can be a cabinet, table, stool, shelf, chest of draws or the like as the piece of furniture when not being used as a fire escape ladder.

A further object is to provide an improved foldable extension escape ladder that is simple and easy to use.

A still further object is to provide an improved foldable extension escape ladder that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
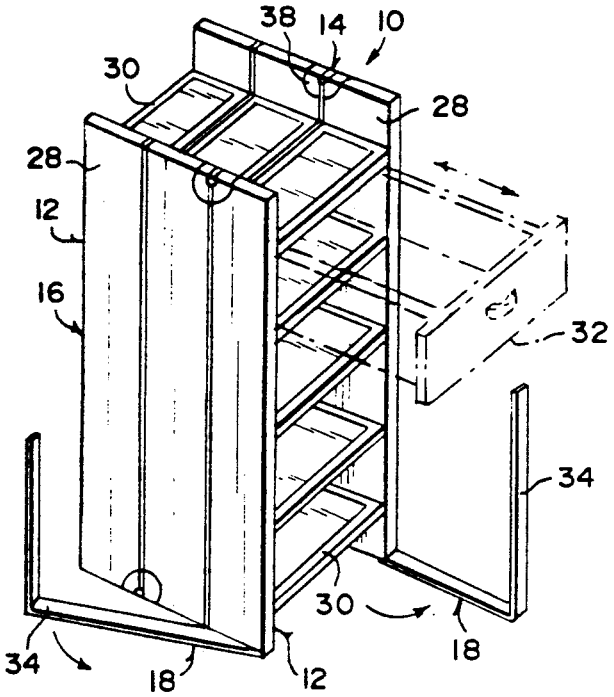
FIG. 1 is a diagrammatic perspective view of a first embodiment of the invention with an optional drawer shown in phantom.

Turning now descriptively to the drawings, in which like reference characters denote like elements throughout the several views, the Figures illustrate an improved foldable extension escape ladder 10 consisting of a plurality of ladder segments 12. A mechanism 14 is for oppositely hinging each ladder segment 12 to each other so that when in a folded position it will be a piece of furniture 16, such as a cabinet, table, stool or the like and when in an unfolded position it will become the fire escape ladder 10. Another mechanism 18 is for retaining the ladder segments 12 together in the folded up position and hanging the ladder segments 12 by the first ladder segment 12, from an open window 20 of a building 22 in the unfolded position so that a person 24 may climb down the foldable extension escape ladder 10 to the ground 26 during a fire.

Each ladder segment 12 includes a pair of side rails 28 and a plurality of rungs 30 extending laterally between the side rails 28. At least one optional drawer 32 can slideably fit between two of the aligned rungs 30 when the ladder segments 12 are in the folded position.

The retaining and hanging mechanism 18 includes a pair of brackets 34 each connected to one side rail 28 of the first ladder segments 12 so that when the ladder segments 12 are in the folded up position the bracket 34 will be closed to hold the ladder segments 12 together. When the ladder segments 12 are in the unfolded position the brackets 34 will be opened to hook onto the open window 20 of the building 22 to allow the ladder segments 12 to extend down towards the ground 26.

Figure 1A:
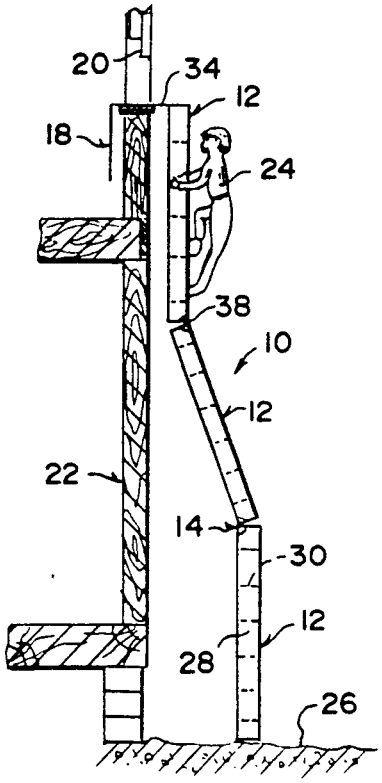
FIG. 1A is a diagrammatic perspective illustrating how the invention unfolds into an escape ladder.
Figure 2:
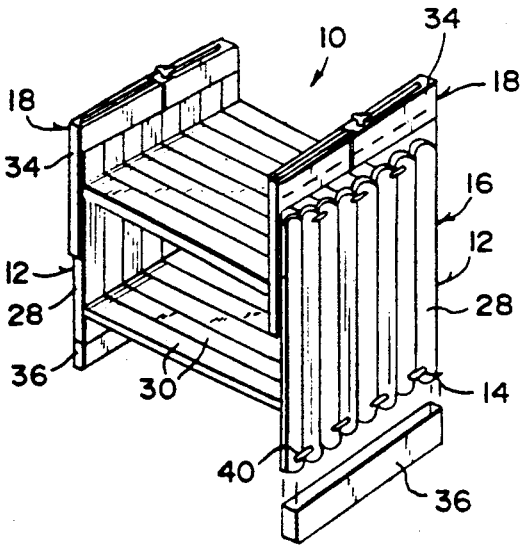
FIG. 2 is a diagrammatic perspective view of a second embodiment of the invention.
Figure 2A:
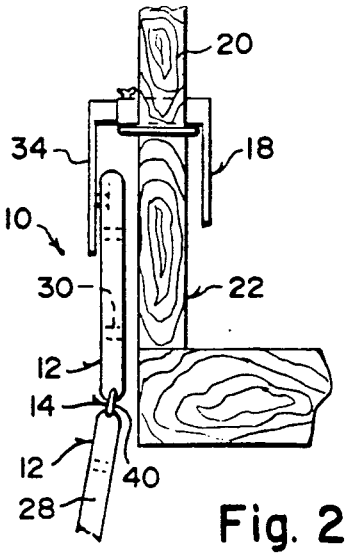
FIG. 2A is an enlarged diagrammatic view illustrating how the second embodiment unfolds and is secured to a building when it is to be used as an escape ladder.

The bracket 34 can be of a one piece construction shown in FIGS. 1 and 1A or adjustable as shown in FIGS. 2 and 2A. Decorative end caps 36 can also be utilized as shown in FIG. 2. Mechanism 14 can either be semi concealed hinges 38 as in FIGS. 1 and 1A or links 40 as in FIGS. 2 and 2A.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved foldable extension escape ladder which comprises:

a) a plurality of ladder segments;

b) means for oppositely hinging each said ladder segment to each other so that when in a folded position it will be a piece of furniture and when in an unfolded position it will become said escape ladder; and c) means for retaining said ladder segments together in the folded up position and hanging said ladder segment, from an open window of a building in the unfolded position so that a person may climb down said escape ladder to the ground during a fire.

2. An improved foldable extension escape ladder as recited in claim 1, wherein each said ladder segment includes:

a) a pair of side rails; and b) a plurality of rungs extending laterally between said side rails.

3. An improved foldable extension escape ladder as recited in claim 2, further including at least one drawer to slideably fit between two of said aligned rungs when said ladder segments are in the folded position.

4. An improved foldable extension escape ladder as recited in claim 3, wherein said retaining and hanging means includes a pair of brackets, each connected to one side rail of the first ladder segment so that when said ladder segments are in the folded up position said brackets will be opened to hook onto the open window of the building to allow said ladder segments to extend down towards the ground.

* * * * *